US006050302A

United States Patent [19]

Guse et al.

[11] Patent Number: 6,050,302

[45] Date of Patent: Apr. 18, 2000

[54] METHOD AND DEVICE FOR FAST SET-UP OR RETROFIT OF A WEAVING MACHINE

[75] Inventors: Rolf Guse, Reutlingen; Hansjürgen Horter, Deizisau, both of Germany

[73] Assignee: Deutsche Institute fur Textil-und Faserforschung, Denkendorf, Germany

[21] Appl. No.: 09/045,238

[22] Filed: Mar. 20, 1998

[30] Foreign Application Priority Data

Mar. 21, 1997 [DE] Germany ..... 197 12 037

[51] Int. Cl.[7] ..... D03J 1/00

[52] U.S. Cl. ..... 139/1 R; 139/85

[58] Field of Search ..... 139/1 R, 85, 86, 139/59; 28/208

[56] References Cited

U.S. PATENT DOCUMENTS

| | | | |
|---|---|---|---|
| 4,513,789 | 4/1985 | Bowen, Jr. . | |
| 4,910,837 | 3/1990 | Fujimoto et al. | 139/1 R |
| 4,934,413 | 6/1990 | Yao . | |
| 5,309,950 | 5/1994 | Bassi et al. . | |
| 5,371,930 | 12/1994 | Lindenmuller et al. | 139/1 R |
| 5,372,164 | 12/1994 | Cloer | 139/1 R |
| 5,394,596 | 3/1995 | Lindenmuller et al. | 139/1 R |
| 5,450,880 | 9/1995 | Briner | 139/1 R |
| 5,657,794 | 8/1997 | Briner et al. | 139/1 R |
| 5,775,380 | 7/1998 | Roelstraete et al. | 139/1 R |

FOREIGN PATENT DOCUMENTS

| | | |
|---|---|---|
| 0 620 304 | 10/1994 | European Pat. Off. . |
| 37 08 598 | 10/1987 | Germany . |
| 37 08 598 | 9/1991 | Germany . |
| 40 31 515 | 10/1991 | Germany . |
| 42 13 958 | 4/1993 | Germany . |
| 42 34 563 | 4/1994 | Germany . |
| 40 00 458 | 2/1996 | Germany . |

OTHER PUBLICATIONS

European Search Report, dated Jul. 9, 1998, for EP 98 10 3897 (4 pages).

Bullio, P. G., "in der Weberei wird der Schnellgang eingelegt", textil praxis international 1994, Mârz, pp. 156–160. Untranslated.

*Primary Examiner*—Andy Falik
*Attorney, Agent, or Firm*—Fitch, Even, Tabin & Flannery

[57] ABSTRACT

A method and a device for fast setup or retrofit of a weaving machine, from/to which a warping beam and auxiliary shedding mechanism are removed or supplied for a change in warp and/or for a change in article to be woven. A harness is provided for the weaving machine, which is applied or removed as a unit for the setup or retrofit, under loosening and/or closing of connections to a Jacquard machine and also under release or attachment in the region of a low-tension device.

7 Claims, 10 Drawing Sheets

METHOD AND DEVICE FOR FAST SET-UP OR RETROFIT OF A WEAVING MACHINE

BACKGROUND OF THE INVENTION

1. Field of the Invention

The invention pertains to a method for fast setup or retrofit of a weaving machine, to/from which warping beam and auxiliary shedding mechanism are supplied or removed for a change in warp and/or for a change in article.

2. Description of the Related Art

For weaving machines with shaft device according to the state of the art, it is known how to insert a transport card into the weaving machine during a change in the article to be woven and/or warp, and to use said card to remove the warping beam and also the shafts from the weaving machine. The removed parts are then sent to storage, for example.

SUMMARY OF THE INVENTION

The article of the invention is based on a weaving machine with a different design, in which no shaft device is present. The known removal or insertion method, respectively, thus cannot be carried out.

Therefore it is the purpose of the invention to create a method and also a device which will allow, in a simple manner a change in article and/or warp in weaving machines without a shaft device.

This problem is solved according to this invention in that a harness (Jacquard machine) is provided for the weaving machine, which is applied or removed as a unit for the setup or retrofit, under loosening and/or closing of connections to a Jacquard machine and also under release or attachment in the region of a low-tension device. The basic idea is thus to remove, or to install, respectively, the harness by means of defined interfaces from/to the machine in such a manner that it remains as a functional unit, and thus is removed from or supplied to the weaving machine as a quasimodule. This inherently functional unit can, for example at a later time within the framework of an article change, be inserted back into the machine, whereby without greater effort the weaving process can again be resumed. Due to the detachment or closing of connections to a Jacquard machine, the upper region of the harness can be detached from the Jacquard machine, that is, the single harness cords are separated from the Jacquard machine, or is again connected to the Jacquard machine upon an onset of the harness. In the lower region of the harness there is the so-called low-tension device, that is, the single harness cords are connected to elastic elements, which, in turn, are attached to the machine or in the base region of the erection site of the machine. Since according to the invention, a detachment or a coupling, respectively, of the harness in the region of the low-tension device is possible, then the entire harness can be removed as a unit from, or can again be supplied as a unit to, the weaving machine. Since at the same time with the harness, a removal of the warping beam takes place together with the warp, this means that the removal, storage and/or reapplication of the overall structure occurs in an orderly and thus reproducible manner.

The advantage is that a removal or an onset of the weaving reed takes place while retaining the unit as a whole. In the removal of the weaving reed, the warp remains positioned between the teeth of the weaving reed, so that upon a reapplication, no intake work has to be carried out.

Furthermore, it is an advantage that while retaining the unit, a removal or an onset of a warp stop motion, respectively, takes place. The warp stop motion associated with each warp thread thus remains in its allocation to the particular warp thread, according to this invention, after a removal or after an onset, so that here, too, a resumption of operation after a completed removal is possible in a simple manner based on the retention of the overall module.

According to one additional refinement of the invention, while retaining the unit, a removal or an onset of a cord board, respectively, takes place. The cord board is permeated by the harness threads according to a specified, orderly structure, which is retained after a removal, or upon a reapplication of the harness.

In order to implement the detachment, or the closing of connections, respectively, of the harness threads to a Jacquard machine in a simple manner, fast snaps are provided so that a fast and simple connection is possible.

Furthermore, it is an advantage that at least one retention element joined to the harness is detached from at least one receiving element, or is attached to it, irrespectively, in the region of the low-tension device for the release or attachment of the harness. The retention element can be detached from the receiving element during a removal of the harness, that is, the orderly structure of the harness threads held against the holding element with intermediate elastic components or sections, is retained. By removal of this retention element, the entire harness can be separated in its lower region from the machine, or from a mount allocated to the machine erection site.

Already completed fabric, according to a refinement-of the invention, is separated for release from the warping beam. To this extent, the profile of the warp from the warping beam to the separated fabric, that is, to the region just in front of the warping beam, is retained in an orderly structure after a removal.

The invention further pertains to a device for the setup or retrofitting of a weaving machine, characterized by the formation as a harness transport cart which consists of the receiving devices for the removal or acceptance, respectively, of a harness assembly including harness cords, cord board and low-tension device. In particular, it is provided that the harness transport cart has a receiving device for a removal or reception, respectively, of further harness assembly components, including warping beam, warp stop motion and/or weaving reed.

DETAILED DESCRIPTION OF THE PREFERRED EMBODIMENT

Figure 1:
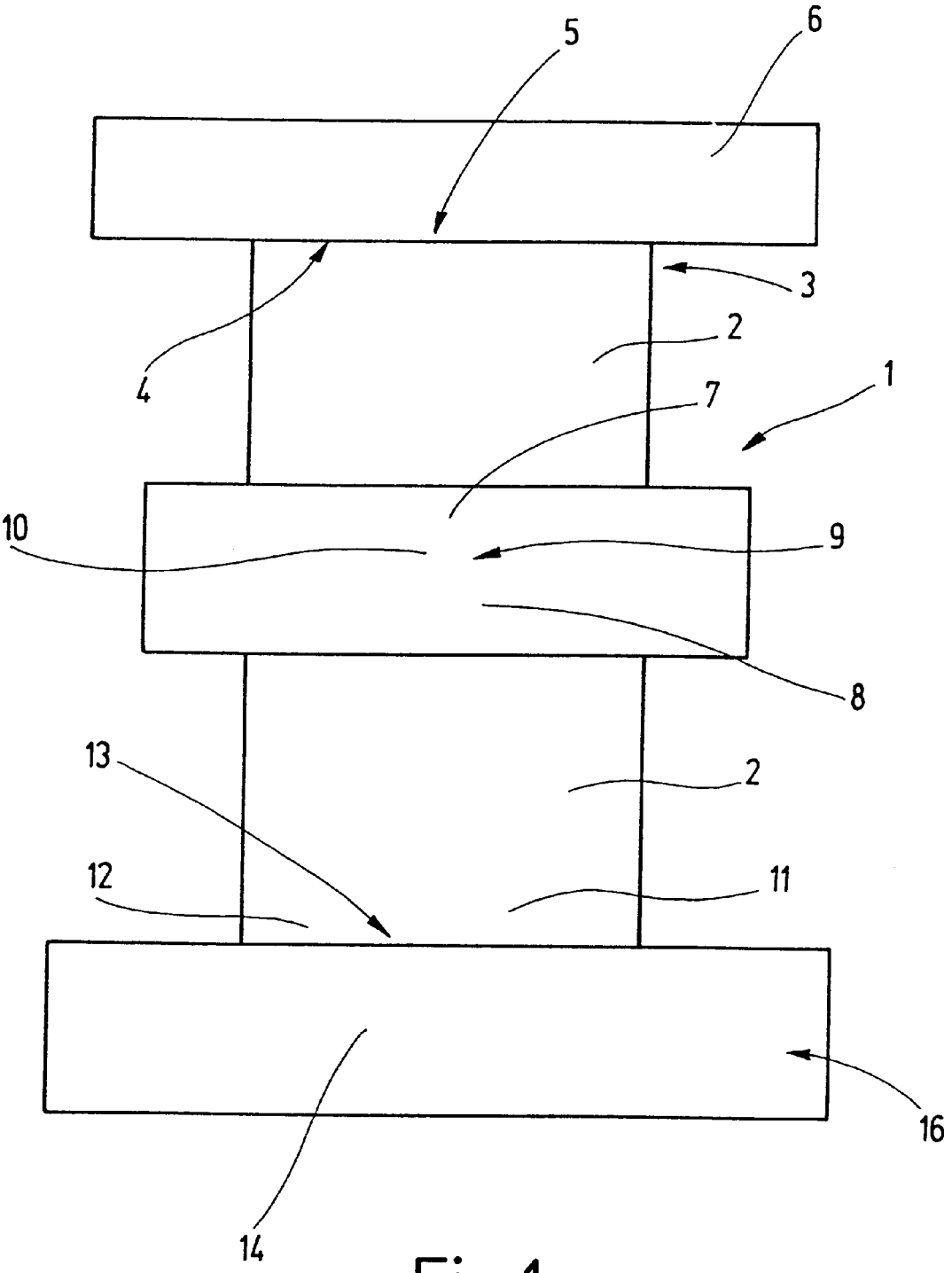
FIG. 1 is a block diagram that illustrates the invented method.
Figure 8:
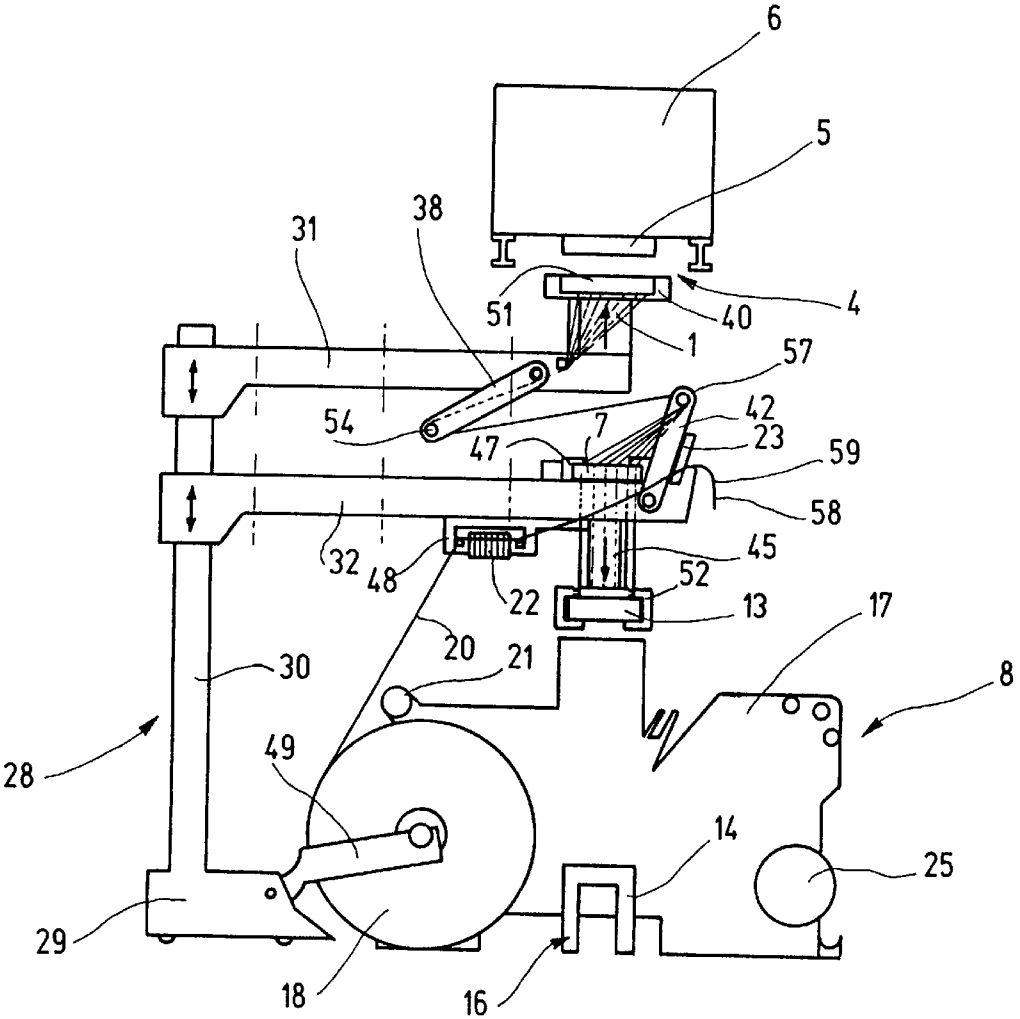
FIG. 8 shows the harness transport cart introduced into the weaving machine according to FIG. 7.

FIG. 1 shows a block diagram which illustrates the arrangement of a harness assembly employed in a weaving machine equipped with Jacquard machine. The harness 1 of the assembly features harness cords 2 which are detachably connected at their upper end 3 to collets 5 of a Jacquard machine 6 by means of releasable connectors such as fast snaps 4 (not illustrated). Viewed from top to bottom, the harness cords 2 pass through a cord board 7 which is detachably attached to the base frame of a weaving machine 8 (see FIG. 8). Beneath the cord board there is an auxiliary shedding mechanism 9 which is formed from strands 10 located in the-particular longitudinal profile of the harness cords 2. That is, the individual harness cords 2 are connected to the individual strands 10. The strands 10 continue downward to a low-tension device 11. The low-tension device 11 has restoring springs 12 and the harness cords 2 are attached to the upper ends of the springs. The lower ends of the restoring springs 12 are attached to a preferably common retaining element 13 which is detachably connected to a receiving element 14. The receiving element 14 is fixed in position, for example, attached to the base frame 17 of the weaving machine 8 or to the floor of the erection site of the weaving machine 8.

Figure 2:
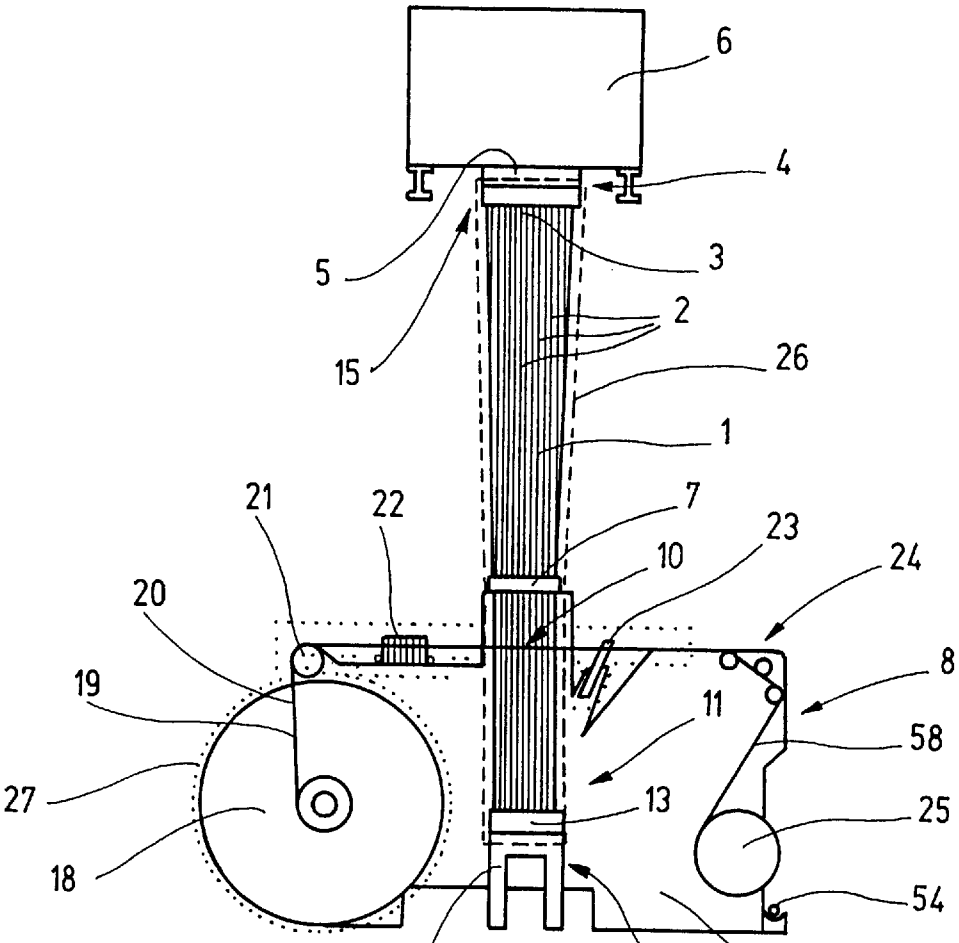
FIG. 2 is a schematic view of a weaving machine equipped with harness and Jacquard machine.

FIG. 2 illustrates the above discussion by using a schematic illustration of the arrangement. It is evident that the collets 5 of the Jacquard machine 6 are connected by means of the fast snaps 4 to the upper ends 3 of the harness cords 2, whereby the coupling takes place preferably by means of a fast-snap system, with which it is possible in a simple manner to connect or to detach, respectively, a number of harness cords 2 to the collets 5 of the Jacquard machine 6 in one working pass. Furthermore, in the lower region of the harness cord 2 it is evident that the retaining element 13 is attached to a lower structure 16 with U-shaped cross section forming the receiving element 14. A warping beam 18 is attached to the base frame 17 of the weaving machine 8, from which a warp 20 formed from a number of warp threads 19 emanates; said warp leads via a whip roll 21 and the warp stop motion 22 to the harness 1, there passes through the strands 10 (not illustrated in detail in FIG. 2), and then passes a weaving reed 23 and then passes via a product take-up unit 24 up to the fabric roller 25.

In FIG. 2 a harness assembly 1 is framed by dashed lines 26 and 27. Dashed line 25 indicates that during a change in article and/or warp, the parts enclosed by the dashed line 26 should be removed, or reapplied, respectively. Parts surrounded by a dashed line 27, namely the warping beam 18, the warp stop motion 22 and the weaving reed 23, which likewise preferably is removed or reapplied during a change in article and/or warp. We will discuss this in detail below.

Figure 3:
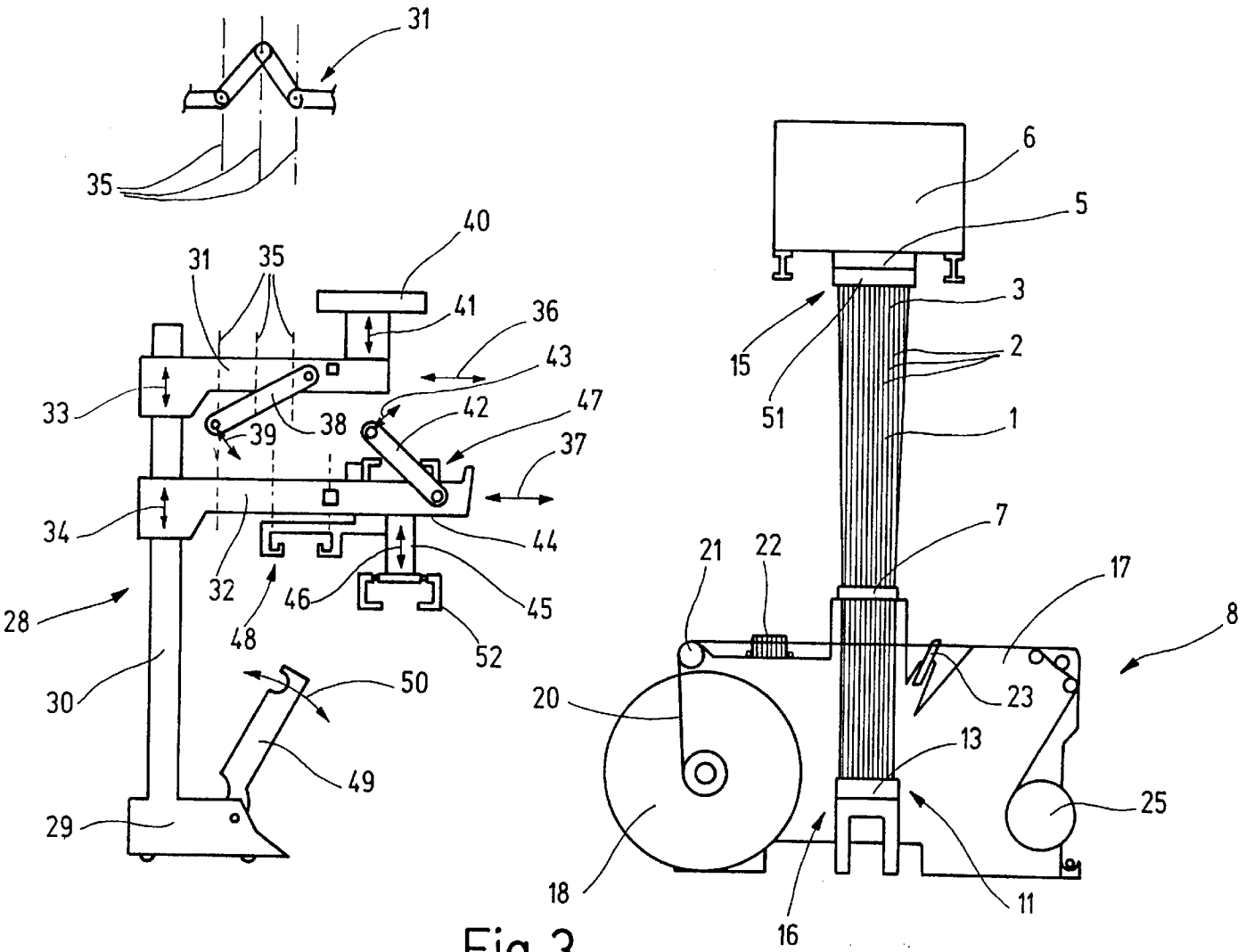
FIG. 3 shows the weaving machine of FIG. 2 with an empty harness transport cart moved up.

In order to perform the mentioned change in article and/or warp, according to FIG. 3, a harness transport cart 28 is used. It has a chassis section 29 to which a vertical support 30 is attached, which has two booms with adjustable height, namely an upper boom 31 and a lower boom 32. The height adjustment of the two booms 31 and 32 is indicated by means of doable arrows 33 and 34. The two booms 31 and 32 are designed as kink arm extenders so as to be laterally or horizontally extendable, that is, according to a detailed view sketched above the harness transport cart, they have several arm sections so that a three-joint system is formed based on three pivot axes 35, so that the arm length of the two booms 31 and 32 car. be varied in the direction of the double arrows 36, 37.

At the upper boom 31 a pivot arm 38 can rotate freely so that it can be displaced in the direction of the double arrow 39. Furthermore, the upper boom 31 has a hoisting device 40 which can telescope in the direction of the double arrow 41 and can also he retracted.

The lower boom 32 has a pivot arm 42 which can be displaced in the direction of the double arrow 43. It is evident that the two pivot arms 38 and 42—viewed from the side of the harness transport cart according to FIG. 3—are positioned laterally offset with respect to each other. At the underside 44 of the lower boom 32 there is a hoisting device 45 which can be extended and retracted vertically in the direction of the double arrow 46. Furthermore, at the lower boom 32—perhaps by intermediate positioning of additional structural elements—a cord board holder 47 and a warp stop motion 48 are provided. A warping beam grasper 49 is attached to the chassis part 29 and can pivot and move in the direction of the double arrow 50.

Figure 4:
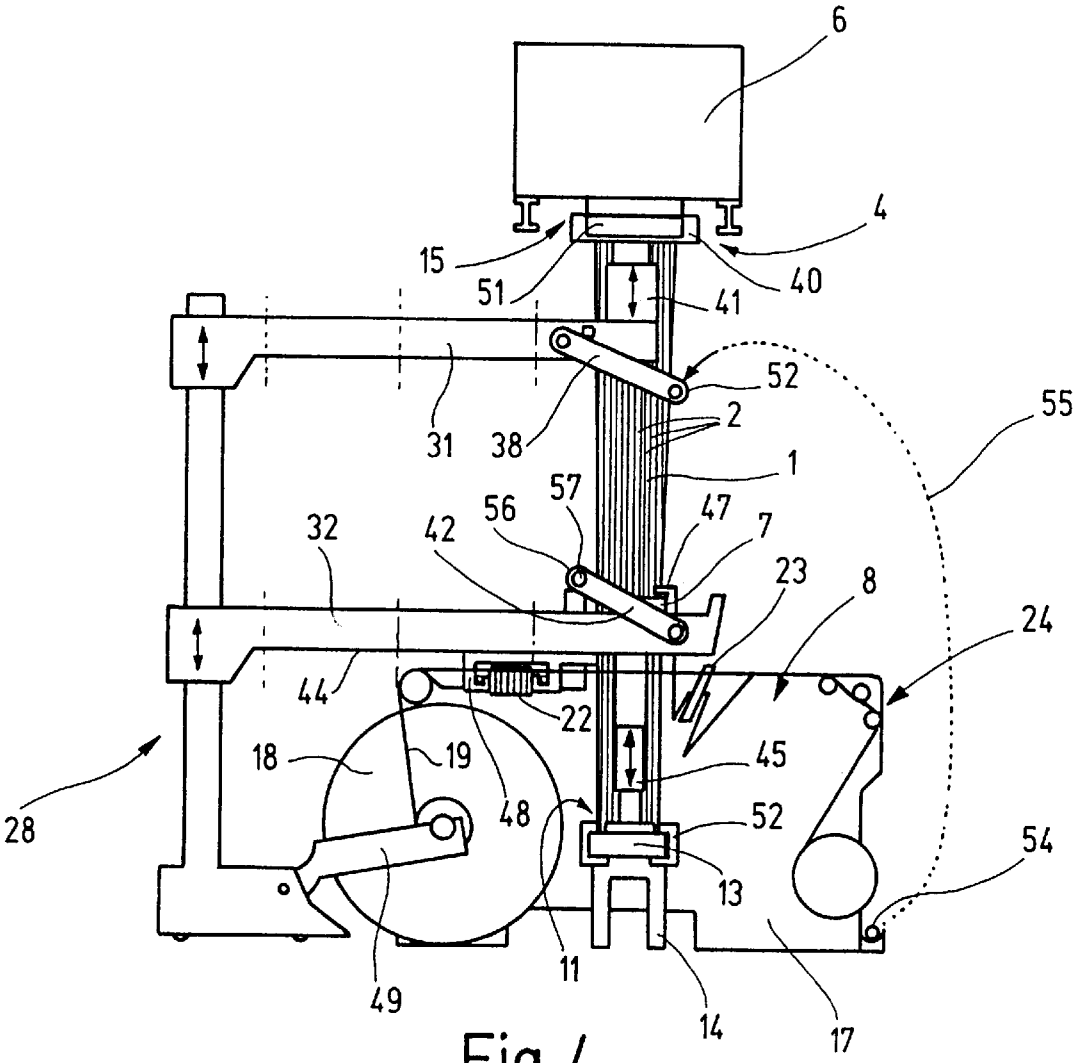
FIG. 4 shows the harness transport cart inserted into the weaving machine according to FIG. 3.

In order to remove the harness assembly 1, that is, the harness cords 2, the cord board 7 and also the retaining element 13 together with the warp 20, the warp stop motion 22, the weaving reed 23 and preferably a short section of the perhaps already completed fabric from the weaving machine 8, the harness transport cart 28 according to FIG. 4 is inserted into the weaving machine 8. With the warp 20 also, the warping beam 18 is removed from the weaving machine 8. Specifically, we proceed as follows: The initially empty harness transport cart 28 shown in FIG. 3 is moved up to the weaving machine 8 in such a manner that the warping beam grasper 49 comes to rest underneath the rotary axis of the warping beam 18.

Since the weaving machine 8 extends into the paper plane of FIG. 4, it is necessary to hold the individual components at their ends, or at their end regions. In this regard the harness transport cart 28 is equipped with two chassis parts 29, vertical supports 30 and also booms 31 and 32 (not visible in the figures) and such, which engage at a spacing from each other, in the particular end regions of the weaving machine 8, whereby these two parts of the harness transport cart 28 are connected to each other by cross supports and such. The width of the harness transport cart can be easily varied in this manner, that is, it can be adapted to any particular width of weaving machine.

Figure 5:
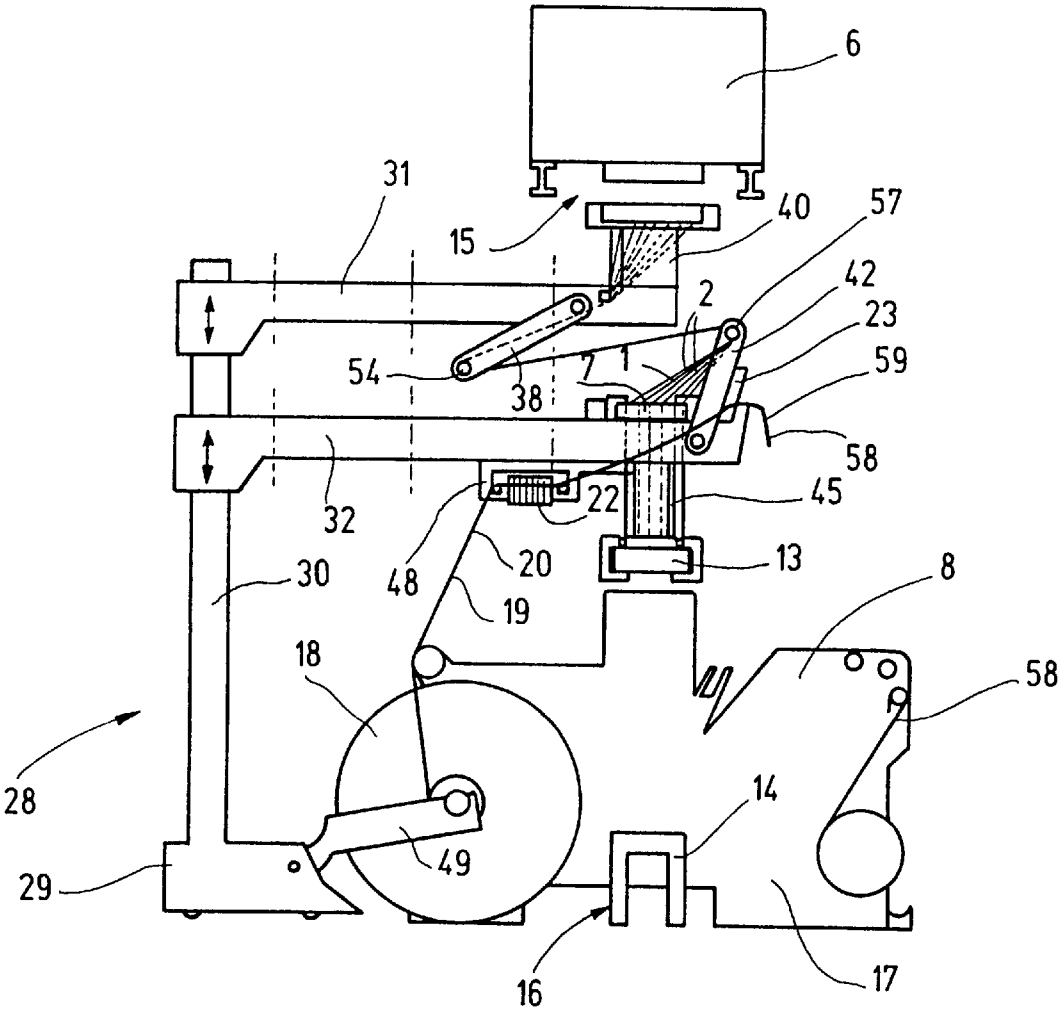
FIG. 5 shows the harness transport cart with picked up harness located in the weaving machine.

In the retracted setting of the harness transport cart 28 shown in FIG. 4, the two booms 31 and 32 are extended by means of their arm sections displaced about the vertical pivot axis 35, so that the hoisting device 40 is located underneath the fist snap system 15 of the harness 1 for connection with the Jacquard machine 6. The grasper-like cord board holder 47 is pushed from the side onto the cord board 7—in both end regions of the cord board—so that the cord board 7 can be locked in place there. The hoisting device 40 is extended out to the upper boom 31, so that the lower part 51 of the fast snap system 15 is held. Thus it is subsequently possible to loosen the fast snaps 4 of the harness cords 2 to the collets 5, without the harness 1 collapsing, that is, the tension of the harness threads 2 is retained. Furthermore, the hoisting device 45 located at the lower boom 32 remains in an extended position so that by means of a grasper-shaped holder 52, the retaining element 13 of the low-tension device 11 is held. Based on the holding of the holding element 13 by means of the grasper-like holder 52, the retaining element 13 can be detached from the holding element 14, without the harness 1 losing its tension. The pivot arms 38 of the two upper booms 31 are pivoted into the position indicated in FIG. 4, in such a manner that the free ends 53 of the pivot arms 38 rest on the side of the harness 1 opposite the cart 28. There the two free ends 52 are joined together by means of a cross strut 54 which can be formed as a hollow shaft. The cross strut 54 is located preferably in a holder at the base frame 17 of the weaving machine 8. This activity is indicated by means of a dashed arrow 55. The two pivot arms 42 of the lower boom 32 are located in the position indicated in FIG. 4, that is, their free ends 56 rest upon the opposite side of the harness, viewed relative to the free ends 52 of the pivot arms 38. The free ends 56 are likewise connected with each other by means of a cross strut 57. Next, the warping beam 18 is unlocked and twisted in such a manner that the warp 20 loosens somewhat. Subsequently, the warp stop motion 22 can be held by the warp stop motion holder 48. The warp stop motion holder is designed as a suspension mount to the underside 44 of the lower boom 32. Provided the weaving machine 8 has an edge thread device, then it can also be accepted into the harness transport cart 28 (not shown). Since now the harness 1 detached from the Jacquard machine 6 and also the low-tension device 11 partly held by the harness transport cart 28 are separated from the weaving machine 8 and in addition, the elements connected to the harness 1, like the warp 20 and its associated parts, such as warping beam 18, warp stop motion 22 and such, are likewise held by the harness transport cart 28, the extraction process can now be implemented. In this regard, as indicated in FIG. 5, the fabric 58 will be cut off. The end 59 of the fabric 58 associated with the warping beam 13 will be installed in the front region of the lower boom 32—together with the weaving reed 23 first detached from the weaving machine 8 and then removed.

Next, the hoisting device 45 will travel upward far enough so that the lower side of the holding element 13, or the holder 52, comes to rest above the upper point of the base frame 17 of the weaving machine 8. Furthermore, the hoisting device 40 is moved downward so that a distance to the Jacquard machine 6 is created. Based on the drawing together of the hoisting devices 40 and 45, the harness 1 will relax. In order to prevent the harness cords 2 from leaving their assigned state, the two pivot arms 38 and 41 will pivot, so that the cross struts 54 will move into the harness and also the cross struts 57 will move into the harness, that is, they will have a zig-zag shape.

Figure 6:
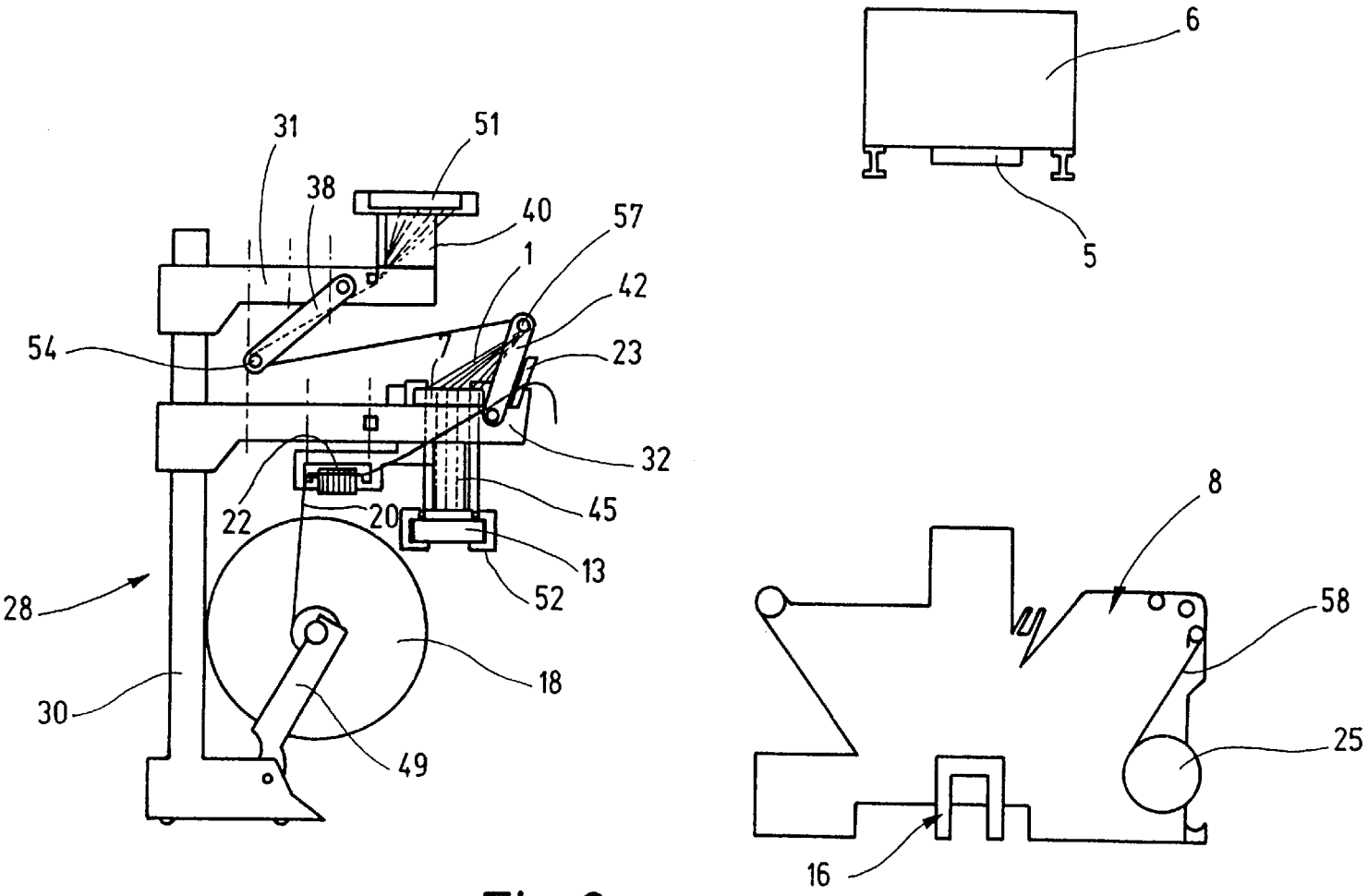
FIG. 6 shows the harness transport cart supporting the harness and extracted from the weaving machine.

According to FIG. 6, subsequently the harness transport cart 28 will be moved out from the weaving machine 8. In order to implement this, first the warping beam grasper 49 will pivot upward, so that the warping beam 18 will be taken from its bearing at the base frame 17. Thus the temporarily not needed harness 1, can be sent to a depot together with warping beam 18, warp 20, warp stop motion 22, cord board 7 and weaving reed 23. It is possible (not shown) that the thus removed harness 1 together with its additional parts will be placed in an arranged manner on a standby cart, in order to store it in the depot in this manner. Thus the harness transport cart 28 is used only for removal and—as will be shown below—for reinsertion of the harness 1.

Figure 7:
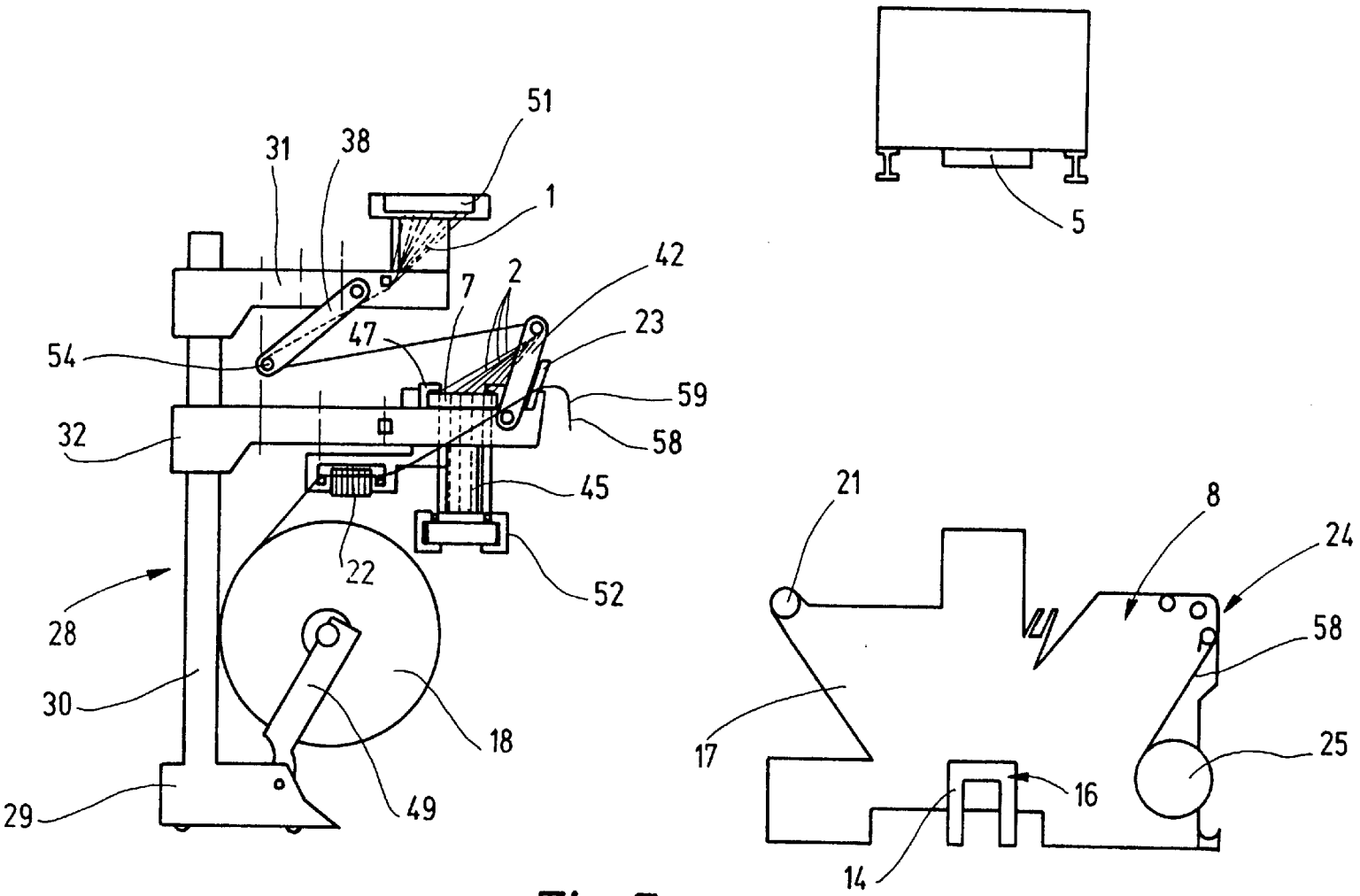
FIG. 7 is a harness transport cart supporting a harness which is to be introduced into a weaving machine.

FIG. 7 shows a reinsertion of a previously not needed harness assembly 1 into the weaving machine 8. The harness transport cart 28 has held the install harness 1 together with the accessory elements in a position like that shown according to FIG. 6—for the removal. The harness transport cart 28 is moved up to the weaving machine 8 such that the position according to FIG. 8 will be assumed. In this position, the warping beam grasper 49 will pivot out and thus the warping beam 18 is inserted into the base frame 17 of the weaving machine 8. The two booms 31 and 32 will be extended, so that they assume the positions indicated in FIG. 8. The upper boom 31 is located in an opposing position to the Jacquard machine 6. The lower boom 32 has a position in which the retaining element 13 can be placed onto the receiving element 14 by vertical extension of the hoisting device 45.

Figure 9:
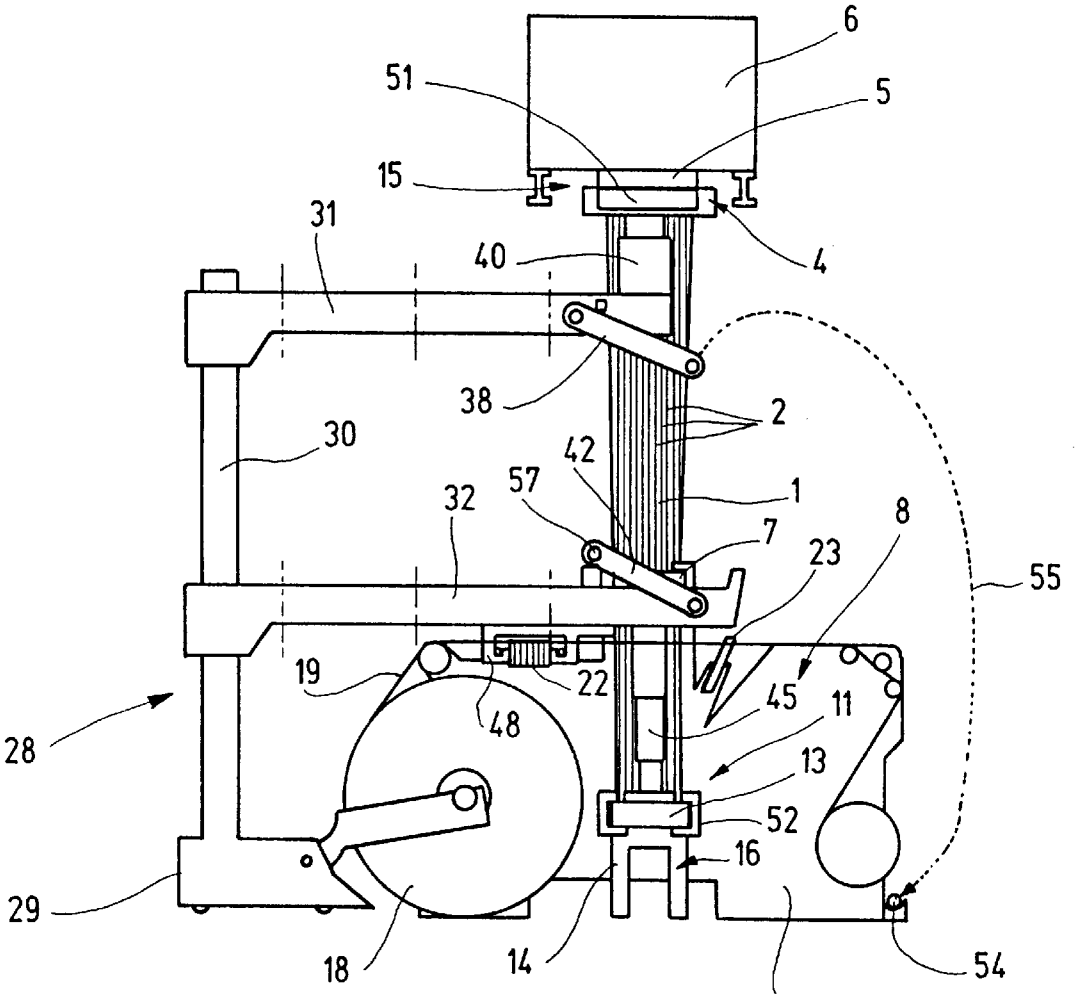
FIG. 9 is the onset of the harness into the weaving machine by means of the harness transport cart.

In the course of further installation of the harness 1 into the weaving machine 8 (according to FIG. 9), the two hoisting devices 40 and 45 will be moved upward or downward, respectively. Next, by means of the fast snaps 4 a coupling of the individual harness threads 2 with the collets 5 of the Jacquard machine 6 will occur.

Simultaneous with the movement of the hoisting device 40 and 45, the pivot arms 38 and 42 pivot from the harness 1 so that a tension will build up on the harness threads 2. The cross strut 54 is subsequently removed from the pivot arms 38 and placed into the mount provided for this at the base frame 17 of the weaving machine 8. The dashed arrow 55 illustrates this activity.

Furthermore, the holding element 13 is fixed in position to the undercarriage 16 and the warp stop motion is removed from the harness transport cart 28 and sent to the weaving machine 8. The weaving reed 23 is likewise brought into its position at the weaving machine 8 and locked. Provided an edge thread device is used, it will also again to sent to the weaving machine 8 (not shown). The detached grasper elements of the cord board holder 47 release the cord board 7 so that also the cord board 7 can be moved back into its position at the base frame 17 of the weaving machine 8.

Figure 10:
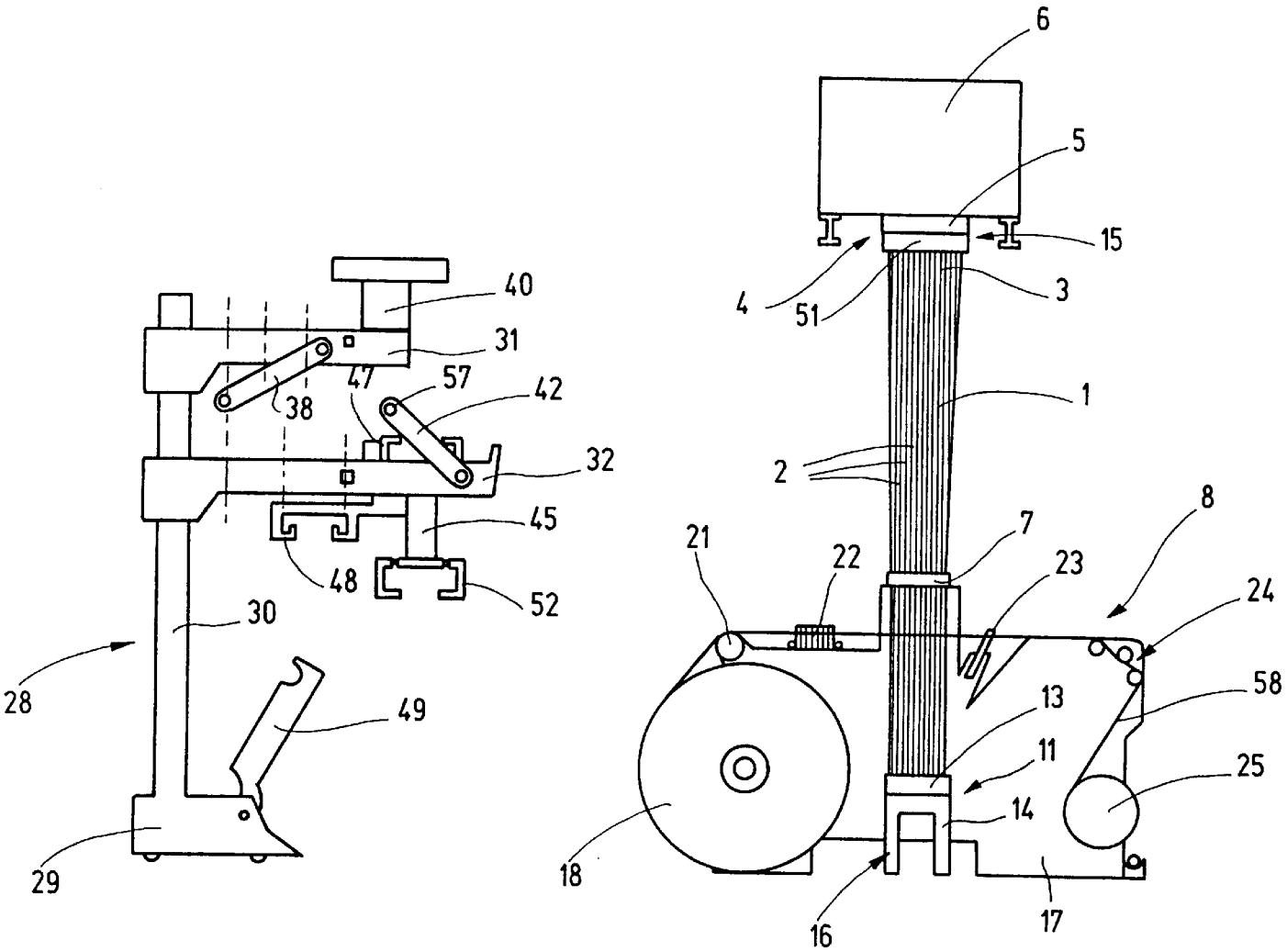
FIG. 10 shows the state after onset of the harness into the weaving machine and extracted harness transport cart.

After the reinsertion of the hoisting devices 40 and 45, the two booms 31 and 32 will pivot in, and the harness transport cart 28 will be moved out from the weaving machine 8 according to FIG. 10. The now empty harness transport cart is thus available for additional article and/or warp change tasks.

According to another design embodiment, it is also possible to use two different transport carts, whereby one is used for the warping beam and the other for the harness. Thus the change process and the construction per cart will be somewhat simpler, but the old warp must be cut before removal of the warping beam and then—after insertion of the new harness and after introduction of the new warping beam—knotted again in the weaving machine. With regard to the warp threads with warp stop motion and of the weaving reed, we proceed such that these elements, already located outside of the weaving room, are pulled into the new harness, but without the warping beam. If the rear portion of the weaving machine with the rear, side parts, the warping beam, the back rail, the warp stop motion and the edge thread device are separable from the front part of the weaving machine, then we have a special design of the weaving machine and the harness transport cart will be simplified in that instead of the special holder for the warping beam, for the warp stop motion, for the edge thread device and such, now only a receiving device is needed for the rear portion of the weaving machine, in addition to the harness and weaving reed holder. The receiving device of the cart will hold the entire rear portion of the weaving machine.

It is a particular advantage when the cord board 7 of the weaving machine 8 has a consistent frame with fixed adjusting holes and that adjusting spindles are provided that correspond to the attachment points of the weaving machine, so that in the mounted position of the cord board 7, they engage in the adjusting holes and in this manner allow a precise alignment. The frame of the cord board is held by means of a fast snap device to the attachment sites of the base frame 17 of the weaving machine 8, whereby this can be reinforced by the use of spring force, lever force, electrical or pneumatic devices. A corresponding design can be provided with reference to the retaining element 13 and the holding element 14, that is, an adjusting hole/adjusting spindle lead, and the use of a fast snap device in order to join the parts together or to detach them from each other.

What is claimed is:

1. Method for the set up or retrofit of a weaving machine arrangement including a warping beam mechanism, an auxiliary shedding mechanism, a low tension device having first and second portions and a Jacquard machine, in which the warping beam and auxiliary shedding mechanism are exchanged on demand, the steps comprising:

providing a harness assembly for at least one of the weaving machines and the Jacquard machines having a unit grouping of harness cords with harness strands and a first portion of the low tension device for the set up or retrofit;

installation or removal of the harness assembly to the Jacquard machine by releasably coupling or uncoupling the harness cords to the Jacquard machine;

releasing or coupling the harness assembly to the second portion of the low-tension device; and applying tension to the unit grouping of harness cords to allow the installation or removal of weaving machine components including the warping beam and auxiliary shedding mechanisms.

2. Method according to claim 1, wherein the weaving machine components further comprise a weaving reed, the method further comprising the step of installing or removing the weaving reed while said tension is applied to the unit grouping of harness cords.

3. Method according to claim 1, wherein the weaving machine components further comprise a warp stop motion, the method further comprising the step of installing or removing the warp stop motion while said tension is applied to the unit grouping of harness cords.

4. Method according to claim 1, wherein the weaving machine components further comprise a cord board, the method further comprising the step of installing or removing the cord board while said tension is applied to the unit grouping of harness cords.

5. Method according to claim 1, further comprising the step of providing the harness cords and the Jacquard machine with cooperating releasable fasteners and wherein said step of releasably coupling or uncoupling the Jacquard machine to the harness cords includes joining or separating said releasable fasteners.

6. Method according to claim 1, further comprising the step of separating already completed fabric from the warping beam to allow removal of the warping beam from the weaving machine arrangement.

7. The combination of a device for the set up or retrofit of a weaving machine, comprising:

a Jacquard harness assembly comprising a unit grouping of harness cords coupled to a retaining element for the setup or retrofit; and a harness transport cart which includes receiving devices for receiving and supporting one or more components of the Jacquard harness assembly.

* * * * *